US006318961B1

(12) United States Patent
Phillipsen

(10) Patent No.: US 6,318,961 B1
(45) Date of Patent: Nov. 20, 2001

(54) AXIAL TURBINE

(75) Inventor: Bent Phillipsen, Rütihof (CH)

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/431,177

(22) Filed: Nov. 1, 1999

(30) Foreign Application Priority Data

Nov. 4, 1998 (DE) ..... 198 50 732

(51) Int. Cl.[7] ..... F01D 1/02; B63H 1/26
(52) U.S. Cl. ..... 415/201; 415/209.4; 416/235
(58) Field of Search ..... 415/189, 190, 415/201, 209.3, 209.4; 416/235

(56) References Cited

U.S. PATENT DOCUMENTS

| | | | | |
|---|---|---|---|---|
| 2,980,396 | * | 4/1961 | Movsesian | 415/189 |
| 3,067,983 | * | 12/1962 | Koziura | 415/209.2 |
| 3,817,655 | * | 6/1974 | Huesgen et al. | 415/189 X |
| 3,985,465 | * | 10/1976 | Sheldon et al. | 415/189 |
| 4,063,845 | | 12/1977 | Allen | 415/134 |
| 4,684,320 | * | 8/1987 | Kunz | 415/190 |
| 5,618,161 | * | 4/1997 | Papageorgiou et al. | 415/190 |

FOREIGN PATENT DOCUMENTS

| | | |
|---|---|---|
| 2445705C2 | 4/1975 | (DE) . |
| 2405050 | 8/1975 | (DE) . |
| 0806547A1 | 11/1997 | (EP) . |
| 0806548A1 | 11/1997 | (EP) . |

OTHER PUBLICATIONS

*Untersuchung und Berechnung axialer Turbinenstufen*, Dejc, et al., 1973, p. 452.

* cited by examiner

*Primary Examiner*—John E. Ryznic
(74) *Attorney, Agent, or Firm*—Burns, Doane, Swecker & Mathis, L.L.P.

(57) ABSTRACT

The object of the invention is to provide an axial-flow turbine having an improved efficiency. In addition, the assembly and dismantling possibilities are to be extended. According to the invention, this is achieved in that the parting seam (17) between the outer ring (12) of the nozzle ring (15) and the cover (8) is arranged on the moving-blade side of an imaginary plane (20) passing through the center of the gap width (19) of the axial gap (18).

4 Claims, 2 Drawing Sheets

AXIAL TURBINE

BACKGROUND OF THE INVENTION

1. Field of the Invention

The invention relates to an axial-flow turbine.

2. Description of the Related Art

The essential components of the axial-flow turbines of fluid-flow machines are the rotor with the moving blades, the nozzle ring and the cover for the moving blades. Slight discontinuities, which result in a reduction in the efficiency, occur in the flow duct of such axial-flow turbines due to unavoidable production and assembly tolerances.

An axial-flow turbine of an exhaust-gas turbocharger has been disclosed by EP 806 547 A1, this axial-flow turbine being subjected to relatively high temperatures during operation of the internal combustion engine connected to it. High thermal stresses thus occur in the turbine-side components, such as, for example, the gas-inlet casing, the nozzle ring, the cover and the gas-outlet casing. Since each of these components is at a different distance from the internal combustion engine and since, in addition, different materials are used, the component temperatures accordingly differ. The result is different thermal expansions with relative movements between the individual components, which may lead to screw fractures, gas leakages and component cracks. The design and arrangement of the separating locations of gas-inlet casing, gas-outlet casing, nozzle ring and cover are therefore of considerable importance for the operability of the axial-flow turbine and thus of the exhaust-gas turbocharger.

Especially critical with regard to thermal expansions is the nozzle ring, which is usually cast and is arranged between the fixed casing parts and the rotating moving blades of an axial turbine. EP 806 548 A1 discloses a solution for the simple and reliable fastening of the nozzle ring. To this end, the nozzle ring bears with its outer ring against the cover and with its inner ring against the gas-inlet casing. An axial expansion gap is formed between the outer ring and the gas-inlet casing, and a radial expansion gap is formed between the outer ring and the gas-outlet casing.

However, it has been found that, in particular also in the case of discontinuities in the transition region between the outer ring of the nozzle ring and the cover, which are also caused by thermal expansions in addition to the production and assembly tolerances already described above, a corresponding decrease in the efficiency can be expected.

In addition, Dejc & Trojanovskij "Untersuchung und Berechnung axialer Turbinenstufen" [Investigation and design of axial turbine stages], VEB Verlag Technik, Berlin, 1973, page 452 (FIG. 7.32: II) discloses a device for the reduction of the gap losses caused by the radial clearance of the turbine blades. To this end, the moving blades are arranged to be stepped relative to the guide blades combined in the nozzle ring and have a positive overlap, i.e. the inner contour of the cover is arranged radially further to the outside in the region of the moving blades than in the region of the guide blades.

During dismantling, however, such a configuration has the disadvantage that the axial-flow turbine can only be displaced in the opposite direction to the nozzle ring and not in both directions.

SUMMARY OF THE INVENTION

The object of the invention, in attempting to avoid all of these disadvantages, is to provide an axial-flow turbine having an improved efficiency. In addition, the assembly and dismantling possibilities are to be extended.

According to the invention, this is achieved in a device according to the preamble of claim 1 in that the parting seam between the outer ring of the nozzle ring and the cover is arranged on the moving-blade side of an imaginary plane passing through the center of the gap width of the axial gap.

As a result, the outer ring of the nozzle ring is extended in the direction of the moving blades, so that the flow duct has no discontinuities at all over most of the gap width of the axial gap. An improvement in the flow conditions and in the efficiency of the axial-flow turbine can thus be achieved.

In an especially advantageous manner, the parting seam between outer ring and cover is arranged directly upstream of the moving blades. In this case, virtually the entire gap width of the axial gap is formed without discontinuities, as a result of which a further increase in the efficiency of the axial-flow turbine is made possible.

It is especially expedient if the inner contour of the cover is additionally arranged radially outside the inner contour of the outer ring. Obtained in this case is a step having a so-called positive blade overlap, which reduces flow over the moving blades in their upstream region and, in combination with the markedly reduced discontinuity, can lead to a disproportionate increase in the efficiency.

As a result of the arrangement of the parting seam between outer ring and cover directly upstream of the moving blades, no overlap of the moving blades by the cover radially to the inside is necessary in the region of the guide blades. This overlap and thus the production of the requisite step is now taken over by the outer ring of the nozzle ring, which in turn projects radially inward beyond the inner contour of the cover of the moving blades. Despite the use of such an advantageous blade overlap, the axial-flow turbine, after removal of the nozzle ring, can therefore be dismantled on both sides, which was not possible hitherto.

Furthermore, it is advantageous if the blade profile, provided with a pressure side, a suction side and a blade tip, of each moving blade is designed in such a way that a bracket projecting beyond the blade profile at least on the pressure side is arranged on the blade tip. The flow over the blade tip, which flow is detrimental to the efficiency, can be markedly reduced by the vortex forming in the region of the bracket.

Finally, a web projecting beyond the bracket in the direction of the cover is advantageously arranged on the blade tip. This web reduces the gap losses in the radial gap formed between the moving blades and the cover.

BRIEF DESCRIPTION OF THE DRAWINGS

An exemplary embodiment of the invention is shown in the drawing with reference to the axial-flow turbine of an exhaust-gas turbocharger. In the drawing.

Only the elements essential for the understanding of the invention are shown. Not shown, for example, are the compressor side of the exhaust-gas turbocharger and the connection to the internal combustion engine. The direction of flow of the working media is designated by arrows.

DETAILED DESCRIPTION OF THE INVENTION

Figure 1:
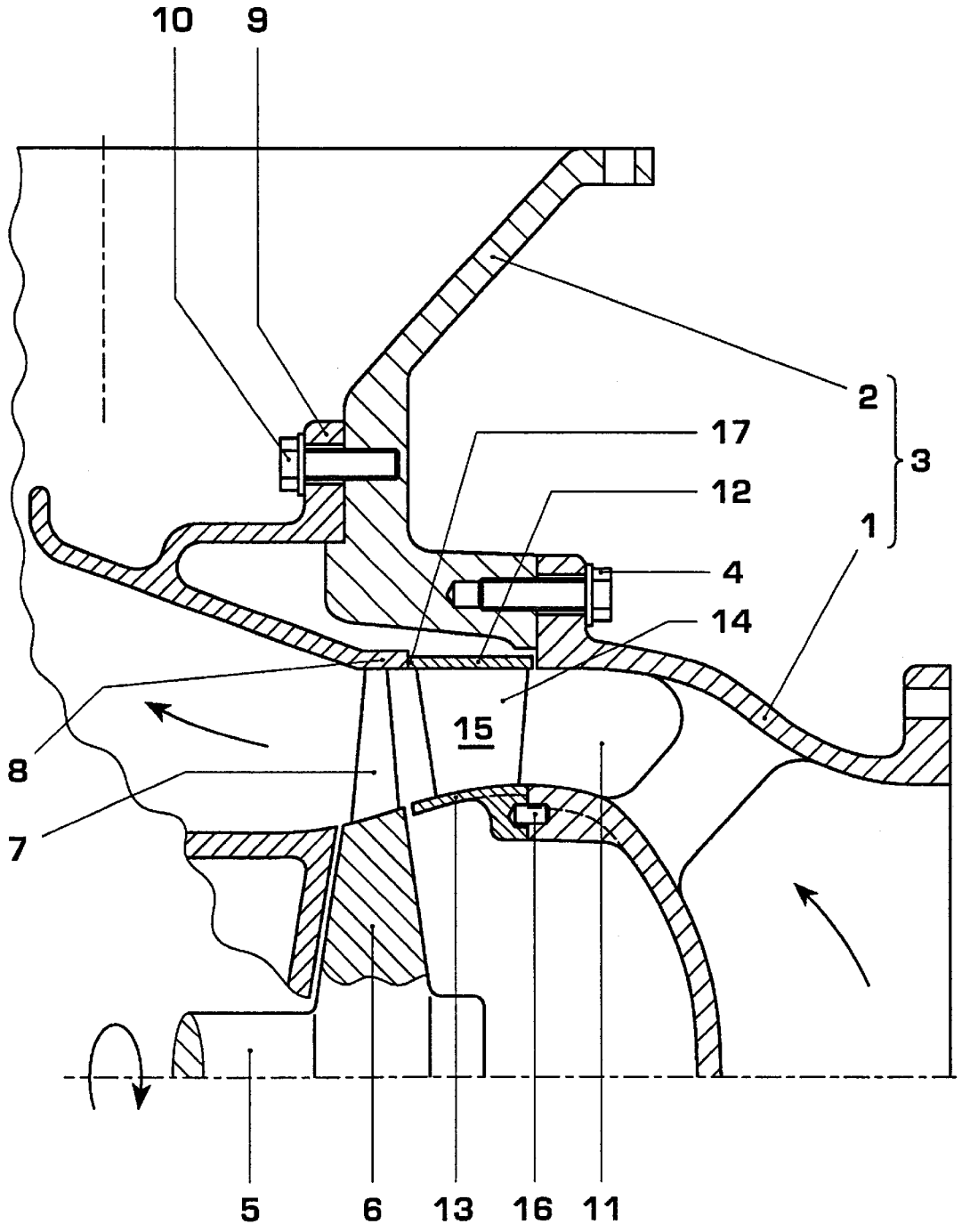
Fig. 1 PRIOR ART
FIG. 1 shows a partial longitudinal section of an axial-flow turbine of the prior art.

The axial-flow turbine, shown in FIG. 1 as prior art, of an exhaust-gas turbocharger has a turbine casing 3, which is formed by a gas-inlet casing 1 and a gas-outlet casing 2 and is held together by means of connecting elements 4 designed as screws. A rotor 6 carried by a shaft 5 and having moving blades 7 is arranged in the turbine casing 3. The rotor 6 is defined on the outside by a cover 8, which is designed as a diffuser and is in turn fastened to the gas-outlet casing 2 via a flange 9 and by means of screws 10. Formed between the rotor 6 and the turbine casing 3 is a flow duct 11, which receives the exhaust gases of a diesel engine (not shown) connected to the exhaust-gas turbocharger and transmits them to the moving blades 7 of the rotor 6. Another internal combustion engine may of course also be connected to the exhaust-gas turbocharger.

Upstream of the moving blades 7, a nozzle ring 15, which consists of an outer ring 12, an inner ring 13 and a number of guide blades 14 formed in between and is designed as a cast part, is arranged in the flow duct 11. The nozzle ring 15 is restrained axially between the cover 8 and the gas-inlet casing 1 and is arranged radially inside the gas-outlet casing 2. To this end, the nozzle ring 15 bears with its outer ring 12 against the cover 8 and with its inner ring 13 against the gas-inlet casing 1. The inner ring 13 is supported on the gas-inlet casing 1 in a rotationally locked manner by means of a plurality of positioning elements 16 designed as pins. A parting seam 17 (FIG. 1) is formed between the outer ring 12 of the nozzle ring 15 and the cover 8. The nozzle ring 15 may of course also be made of other materials, such as, for example, sheet-metal or steel profiles, or may be made of ceramic.

Figure 2:
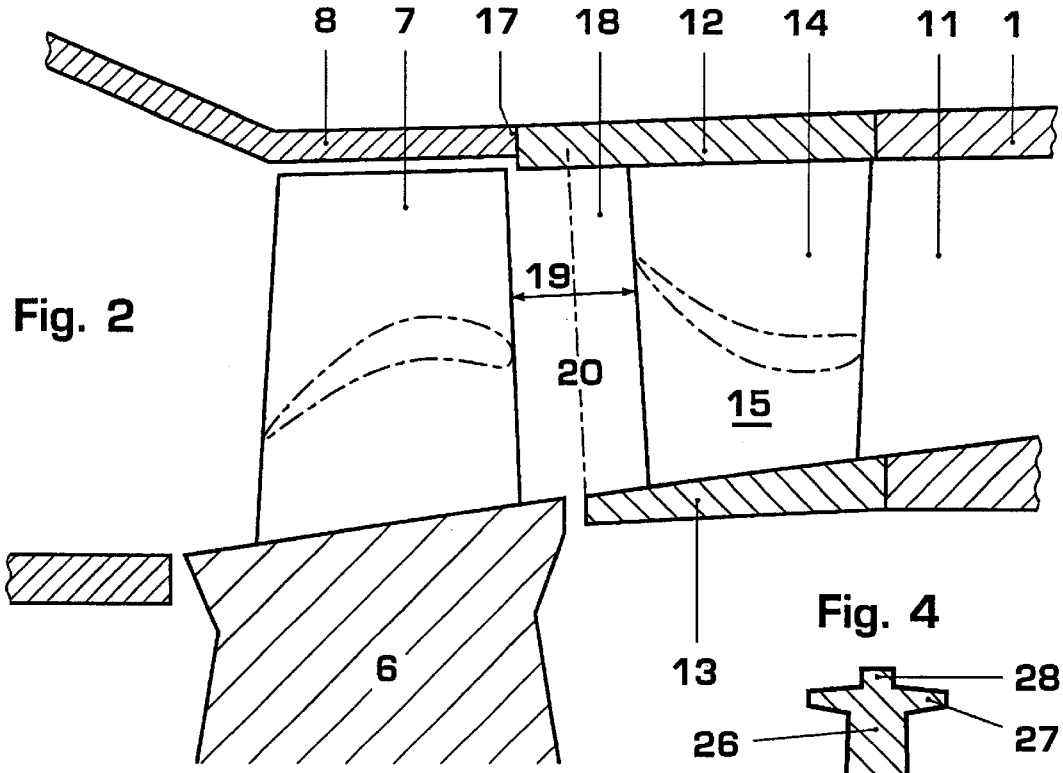
FIG. 2 shows an enlarged detail from FIG. 1 with the design according to the invention of the nozzle ring.

An enlarged detail of FIG. 1 is shown in FIG. 2, this detail showing a first exemplary embodiment of the invention. An axial gap 18 having a gap width 19 is formed between the moving blades 7 and the guide blades 14 of the axial-flow turbine. The parting seam 17 of the outer ring 12 of the nozzle ring 15 and the cover 8 is arranged on the moving-blade side of an imaginary plane 20 passing through the center of the gap width 19 of the axial gap 18. An advantageous arrangement having a parting seam 17 arranged directly upstream of the moving blades 7 is shown.

During operation of the diesel engine, the hot exhaust gases from the diesel engine pass via the gas inlet casing 1 or the flow duct 11 arranged therein to the rotor 6 of the axial-flow turbine. In this case, the task of the nozzle ring 15 is to optimally direct the exhaust gases onto the moving blades 7 of the rotor 6. On the one hand, the rotor 6, which is thus driven, provides for the drive of the compressor (not shown) connected to it. The air compressed in the compressor is used for supercharging, i.e. for increasing the output of the diesel engine.

Due to the arrangement of the parting seam 17 according to the invention directly upstream of the moving blades 7 and the outer ring 12 appropriately extended thereto, the discontinuities to be attributed to production and assembly tolerances are markedly reduced virtually in the entire region of the axial gap 18. The exhaust gases flowing into the axial-flow turbine can therefore pass largely undisturbed via the nozzle ring 15 to the moving blades 7, which ultimately results in an increase in the efficiency.

Figure 3:
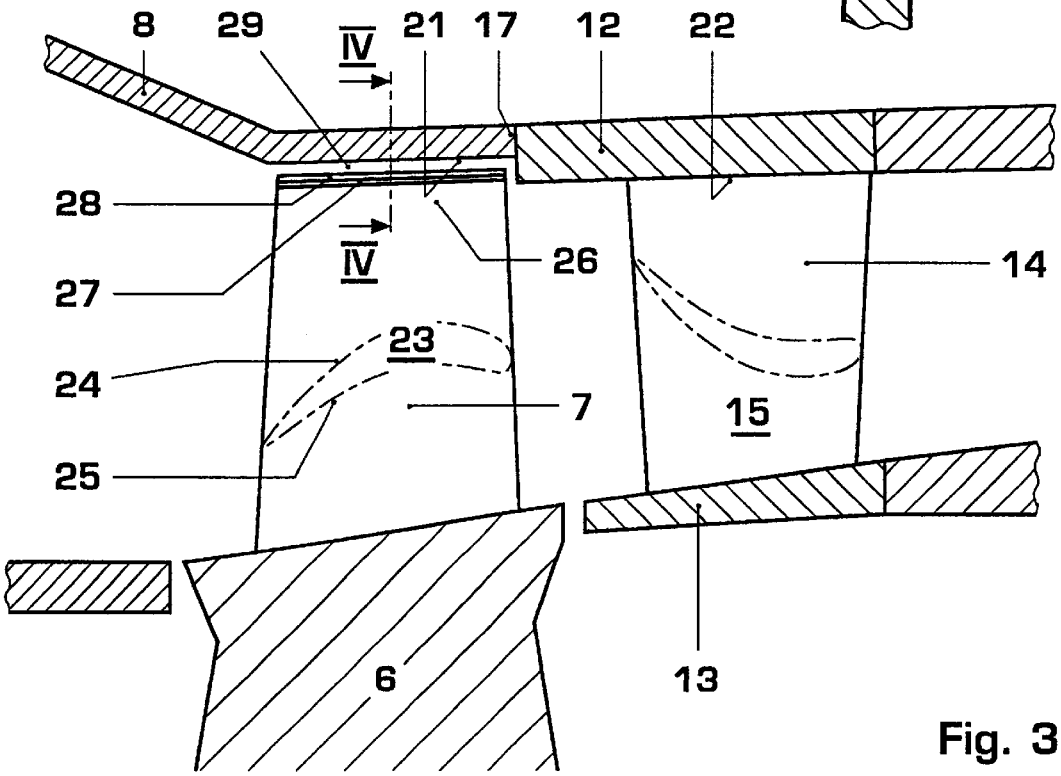
FIG. 3 shows a representation according to FIG. 2 but in a second exemplary embodiment.

In a second exemplary embodiment, both the cover 8 of the moving blades 7 and the outer ring 12 of the nozzle ring 15 have an inner contour 21, 22, the inner contour 21 of the cover 8 being arranged radially outside the inner contour 22 of the outer ring 12 (FIG. 3). This results in a step with a so-called positive blade overlap, which reduces the flow over the moving blades 7 in their upstream region. The overlap of the moving blades 7 by the cover 8, which overlap is known from the prior art and is effected radially to the inside in the region of the guide blades 14, is now taken over by the outer ring 12 of the nozzle ring 15. Despite the use of such an advantageous blade overlap, the axial-flow turbine, after removal of the nozzle ring 15, can therefore be dismantled on both sides, which was not possible hitherto.

Figure 4:
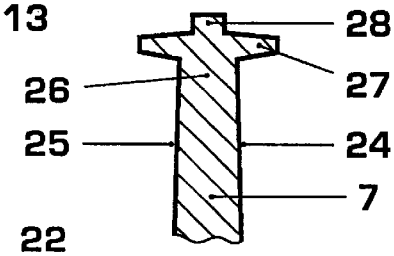
FIG. 4 shows a section through a moving blade along line IV—IV in FIG. 3.

Furthermore, a blade profile 23 of the moving blade 7 is shown in FIG. 3, this blade profile 23 having a pressure side 24, a suction side 25 and a blade tip 26. A bracket 27 projecting beyond the blade profile 23 on both the pressure side and the suction side and a web 28 projecting beyond the bracket 27 in the direction of the cover 8 are arranged on the blade tip 26 (FIG. 4).

The flow over the blade tip 26, which flow is detrimental to the efficiency, is markedly reduced by the bracket 27. In addition, the web 28 reduces any gap losses in the radial gap 29 formed between the moving blades 7 and the cover 8.

What is claimed is:

1. An axial-flow turbine comprising a rotor carrying a number of moving blades, a nozzle ring arranged upstream of the moving blades and comprising an outer ring, an inner ring and a number of guide blades arranged in between, an axial gap formed between the moving blades and the guide blades and having a gap width, and a cover defining the moving blades to the outside, a parting seam being formed between the outer ring of the nozzle ring and the cover, wherein the parting seam between outer ring and cover is arranged directly upstream of the moving blades.

2. An axial-flow turbine comprising a rotor carrying a number of moving blades, a nozzle ring arranged upstream of the moving blades and comprising an outer ring, an inner ring and a number of guide blades arranged in between, an axial gap formed between the moving blades and the guide blades and having a gap width, and a cover defining the moving blades to the outside, a parting seam being formed between the outer ring of the nozzle ring and the cover, wherein the parting seam between outer ring and cover is arranged directly upstream of the moving blades, wherein both the cover and the outer ring have an inner contour, the inner contour of the cover being arranged radially outside the inner contour of the outer ring.

3. An axial-flow turbine comprising a rotor carrying a number of moving blades, a nozzle ring arranged upstream of the moving blades and comprising an outer ring, an inner ring and a number of guide blades arranged in between, an axial gap formed between the moving blades and the guide blades and having a gap width, and a cover defining the moving blades to the outside, a parting seam being formed between the outer ring of the nozzle ring and the cover, wherein the parting seam between outer ring and cover is arranged directly upstream of the moving blades and, wherein each moving blade has a blade profile having a pressure side, a suction side and a blade tip, a bracket projecting beyond the blade profile at least on the pressure side being arranged on the blade tip.

4. The axial-flow turbine as claimed in claim 3, wherein a web projecting beyond the bracket in the direction of the cover is arranged on the blade tip.

* * * * *